US005373702A

United States Patent [19]

Kalet et al.

[11] Patent Number: 5,373,702

[45] Date of Patent: Dec. 20, 1994

[54] LNG DELIVERY SYSTEM

[75] Inventors: George Kalet, Marietta; Keith Gustafson, Waleska, both of Ga.

[73] Assignee: Minnesota Valley Engineering, Inc., New Prague, Minn.

[21] Appl. No.: 89,844

[22] Filed: Jul. 12, 1993

[51] Int. Cl.[5] ..... F17C 9/02

[52] U.S. Cl. ..... 62/50.2; 62/49.1; 62/50.4; 141/4; 123/525; 123/527

[58] Field of Search ..... 62/7, 50.1, 50.2, 48.1, 62/50.4, 49.1, 49.2; 141/4, 5, 18, 21, 82, 95, 197; 123/525, 527

[56] References Cited

U.S. PATENT DOCUMENTS

| | | | |
|---|---|---|---|
| 2,435,332 | 2/1948 | Van Vleet et al. | 62/50.4 |
| 2,453,766 | 11/1948 | Thayer | 62/50.1 X |
| 2,482,778 | 9/1949 | Joerren | 62/50.4 X |
| 2,641,907 | 6/1953 | Baucom | 62/49.1 |
| 2,912,830 | 11/1959 | Coldren et al. | 62/49.1 |
| 2,956,412 | 10/1960 | Loebeck | 62/50.1 X |
| 2,993,344 | 7/1961 | Reed | 62/50.1 X |
| 3,091,096 | 5/1963 | Rendos et al. | 62/50.2 |
| 3,093,974 | 6/1963 | Templer et al. | 62/50.2 |
| 3,272,238 | 9/1966 | Groppe | 62/50.1 X |
| 3,633,372 | 1/1972 | Kimmel | 62/50.1 X |
| 3,710,584 | 1/1973 | Leonard | 62/50.4 |
| 3,962,882 | 6/1976 | Gee et al. | 62/50.1 |
| 4,080,800 | 3/1978 | Spaulding et al. | 62/50.1 |
| 4,406,129 | 9/1983 | Mills | 62/7 |
| 4,527,600 | 7/1985 | Fisher et al. | 141/4 |
| 4,887,857 | 12/1989 | Van Ommeren | 141/5 X |
| 4,987,932 | 1/1991 | Pierson | 141/82 X |
| 5,107,906 | 4/1992 | Swenson et al. | 62/50.2 X |
| 5,121,609 | 6/1992 | Cieslukowski | 62/50.4 |
| 5,127,230 | 7/1992 | Neeser et al. | 62/50.1 X |
| 5,163,409 | 11/1992 | Gustafson et al. | 123/525 |
| 5,228,295 | 7/1993 | Gustafson | 62/50.1 X |
| 5,315,831 | 5/1994 | Goode et al. | 62/50.1 X |

FOREIGN PATENT DOCUMENTS

| | | | |
|---|---|---|---|
| 0019050 | 3/1956 | Germany | 62/50.1 |
| 3131311 | 2/1983 | Germany | 52/50.1 |
| 00051098 | 3/1992 | Japan | 62/50.1 |
| 0490212 | 8/1938 | United Kingdom | 62/50.1 |

*Primary Examiner*—Christopher Kilner

*Attorney, Agent, or Firm*—Rockey, Rifkin and Ryther

[57] ABSTRACT

Two LNG storage tanks receive LNG from a fill station. The two storage tanks are connected to an overflow tank into which the LNG flows during pressurization of the system. The overflow tank is connected to the use device, i.e. the vehicle's engine, through a heat exchanger to provide high pressure natural gas thereto. The fill station initially delivers LNG to the two storage tanks until the tanks are substantially filled with LNG whereupon the fill station automatically stops delivery of LNG and begins to deliver natural gas vapor to the storage tanks until the pressure in the system reaches a predetermined maximum that is equal to or greater than the pressure required by the use device. During the pressurization of the system some of the LNG in the two storage tanks is forced into the overflow tank by the incoming natural gas vapor.

3 Claims, 2 Drawing Sheets

LNG DELIVERY SYSTEM

BACKGROUND OF THE INVENTION

This invention relates, generally, to liquid natural gas (LNG) delivery systems and, more specifically, to a high pressure LNG delivery system particularly suited for use on a natural gas powered motor vehicle.

In order to avoid dependence on foreign sources of fuel oil, great efforts have been made to find a cheap and reliable domestic energy alternative. One such alternative is natural gas (NG) which is domestically available, plentiful and relatively inexpensive and environmentally safe as compared to oil. Because one of the largest uses for oil is as a fuel for motor vehicles, great efforts have been made to develop natural gas powered engines.

Engines that require that the intake pressure of the NG be at elevated pressures, i.e. 300 psig or the like, present a particular problem when one wishes to utilize LNG as the vehicle fuel because LNG is preferably stored at the range of 15 to 50 psig where it is very dense.

One such engine is a dual-fuel modified diesel engine which runs on a 60/40 LNG to diesel fuel mixture. While this engine substantially reduces diesel fuel consumption, it requires that LNG be delivered to the engine at approximately 300 psi, a pressure approximately 6 times the normal storage pressure for LNG. This extremely high pressure causes storage and handling problems for the volatile LNG. These problems are magnified by the fact that when the LNG is carried on a motor vehicle, it is exposed to relatively high temperatures and constant motion. Of particular concern is the difficulty in pressurizing the LNG because the constant motion of the vehicle causes the LNG to mix with the natural gas vapor pressure head thereby condensing the natural gas vapor and collapsing the pressure head. This causes all the stored LNG to heat up to a equilibrium temperature—near that of 300 psig—whereby it increases in volume to a point where it could "liquid over fill" the tank. To compensate, the tank capacity at time of fill cannot be fully utilized, thus undesirably limiting the range of the vehicle. Also for a tank to hold 300 psig it must have a reserve pressure (to accept pressure rise when fueled, but not in use) and a 500 psig rating would be considered normal. Pressure tanks which safely contain 500 psig require much thicker and heavier walls than those which contain 50 psig, and this additional weight reduces the net payload of the vehicle, also an undesirable condition.

Another proposed method of providing 300 psig intake pressure from LNG stored at 15 psig is to provide a pump, whose intake pressure is storage pressure (15–50 psig) and discharge pressure is 300 psig or the like. However, pumps that dependably supply liquid at a rate proportionate to their speed—a desirable function when supplying fuel to an engine where fuel supply determines the vehicle speed—require some Net Positive Suction Head (NPSH). At standard cryogenic pump installations, various methods are utilized to provide NPSH, but most involve stratification and/or hydrostatic head (i.e. sub-cooling) in the pump supply tank. However, tanks containing cryogens (i.e. LNG) tend to quickly destratify and come to equilibrium throughout when vibrated, as would be normally experienced by a bus or truck in motion. Such being the case, a vehicle pump can experience varying NPSH (in fact, as low as 0), thus varying volumetric efficiencies—ranging from no flow to high flow. To a vehicle operator this would produce difficult to control engine/vehicle speed variations, a potentially unsafe condition. Adding a post-pump reservoir and substitute regulator control to smooth out these variations has also been suggested. However, such a reservoir represents high pressure compressed natural gas ("CNG") and constitutes considerable additional equipment. In addition, such a system has difficulty dealing with the boil-off gaseous NG from its stored LNG.

Thus, an efficient high pressure NG delivery system is desired.

SUMMARY OF THE INVENTION

The LNG fuel system of the invention overcomes the above-noted shortcomings of the prior art and consists of two LNG storage tanks for receiving LNG from a fill station. The two storage tanks are connected to an overflow tank into which the LNG flows during pressurization of the system. The overflow tank is connected to the use device, i.e. the vehicle's engine, through a heat exchanger to provide high pressure natural gas thereto. The fill station initially delivers LNG to the two storage tanks until the tanks are substantially filled with LNG whereupon the fill station automatically stops delivery of LNG and begins to deliver natural gas vapor to the storage tanks until the pressure in the system reaches a predetermined maximum that is equal to or greater than the pressure required by the use device. During the pressurization of the system some of the LNG in the two storage tanks is forced into the overflow tank by the incoming natural gas vapor.

DETAILED DESCRIPTION OF THE INVENTION

Figure 1:
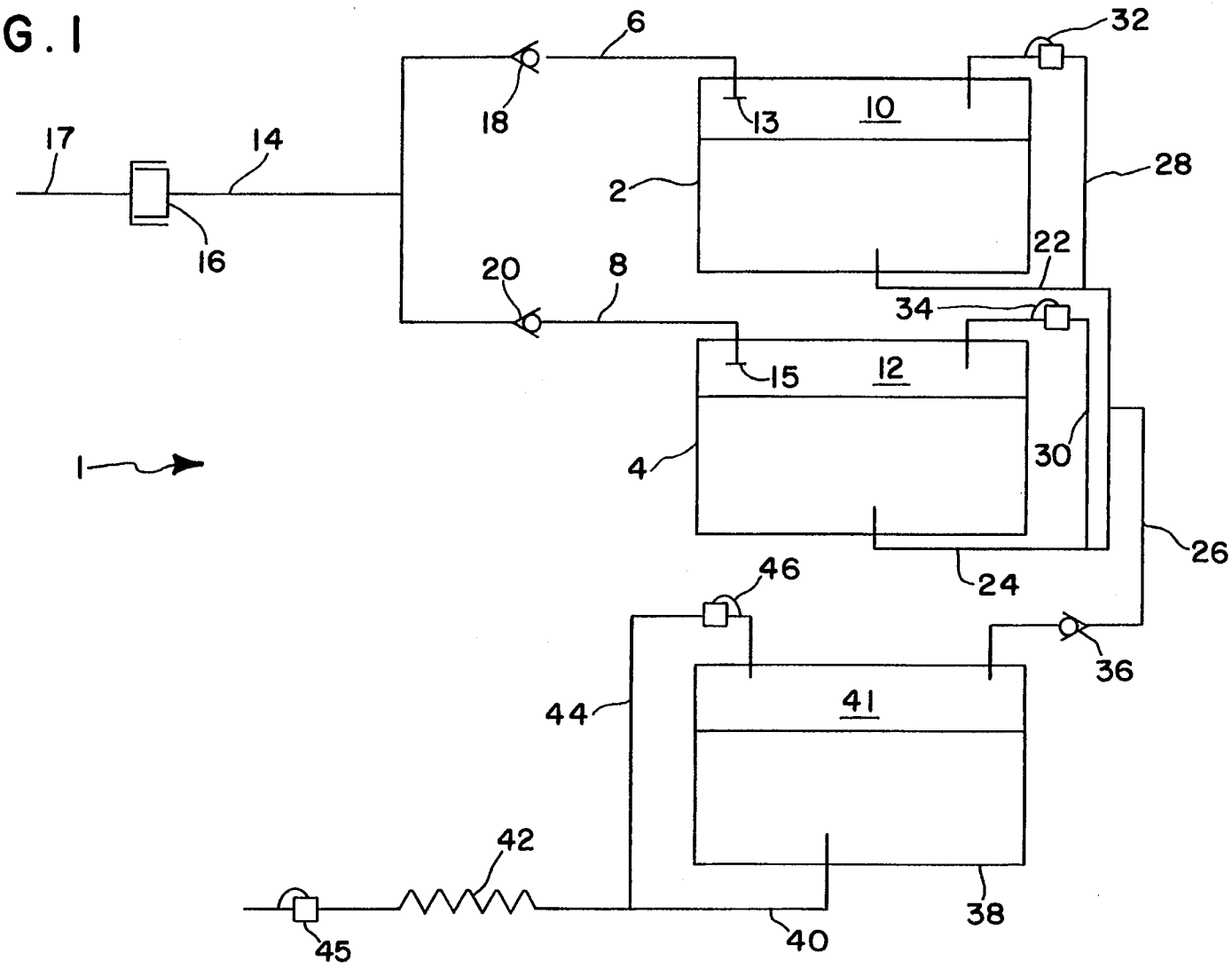
FIG. 1 is a schematic view of the vehicle mounted fueling system of the invention.

Referring more particularly to FIG. 1, the vehicle mounted fueling system of the invention is shown generally at 1 consisting of a first storage tank 2 and a second storage tank 4. Fill lines 6 and 8 connect the vapor spaces 10 and 12 in storage tanks 2 and 4, respectively, to a main fill line 14. Main fill line 14 terminates in a disconnect coupling 16 that can be removably connected to the fill hose 17 of a fill station such as the one shown in FIG. 2. Located in lines 6 and 8 are check valves 18 and 20, respectively, which allow natural gas to pass only in the direction toward the storage tanks. Lines 6 and 8 terminate in spray heads 13 and 15 which spray the incoming LNG into tanks 2 and 4.

Extending from the bottoms of tanks 4 and 6 are LNG delivery lines 22 and 24, respectively, which are connected to a common delivery line 26. Connecting the vapor spaces in tanks 4 and 6 to their respective delivery lines 22 and 24 are natural gas vapor vent lines 28 and 30. Lines 28 and 30 include regulators 32 and 34, respectively, that allow natural gas vapor to vent from tanks 4 and 6 and be delivered to common delivery line 26 when the vapor pressure in tanks 4 and 6 rises above the predetermined limit set at the regulators.

Common delivery line 26 includes a check valve 36 that allows natural gas to travel only in the direction from storage tanks 4 and 6 to overflow tank 38. Line 26 communicates with the vapor space 41 in tank 38 to deliver natural gas thereto from tanks 4 and 6.

A gas use line 40 connects the bottom of overflow tank 38 with the gas use device such as the vehicle's engine. A heat exchanger 42 is provided to vaporize the LNG before it is delivered to the use device. An engine fuel regulator 45 is also provided in line 40 to allow vaporized natural gas to flow to the gas use device when a pressure drop is sensed across the regulator caused by a demand in the use device. Such a demand results, for example, when the vehicle's gas pedal is depressed.

Finally a gas vent line 44 connects vapor space 41 with the gas use line 40. Vent line 44 is provided with a regulator 46 that allows vaporized natural gas to be delivered to the gas use line 40 from vapor space 41 if the pressure in tank 38 should rise above the predetermined limit set at regulator 46.

Figure 2:
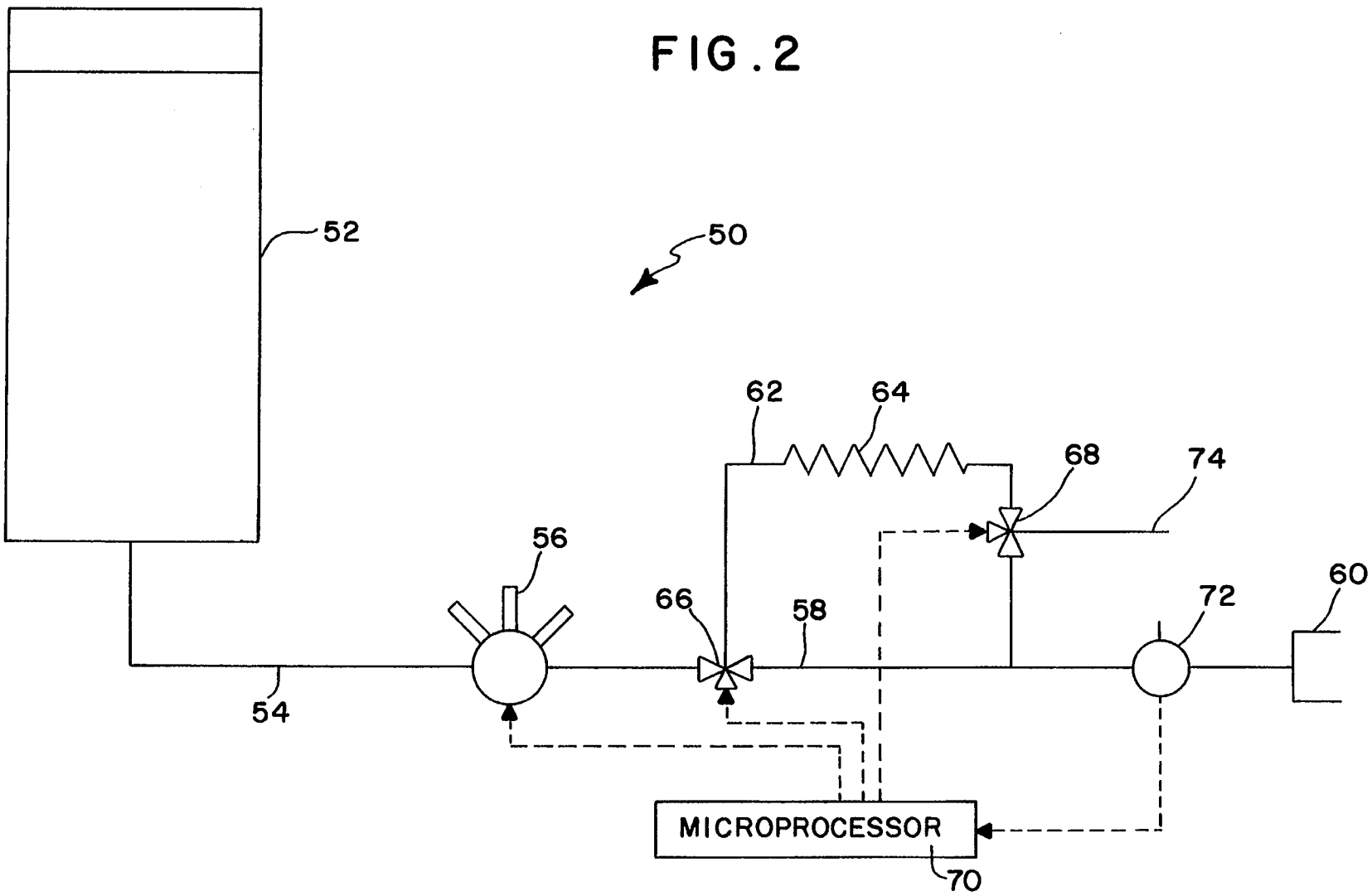
FIG. 2 is a schematic view of the fill station for filling the vehicle mounted system of FIG. 1.

Referring more particularly to FIG. 2, the filling station for delivering natural gas to the fueling system of FIG. 1 is shown generally at 50 and includes a storage tank 52 for storing a large volume of LNG at low pressure. A line 54 connects the LNG in tank 52 to a high pressure gas cylinder filling pump 56 which pumps the LNG from tank 52 through line 58. Line 58 terminates in a disconnect coupling 60 that can be removably connected to disconnect coupling 16 of the vehicle fueling system 1.

A vaporizing loop 62 having a heat exchanger 64 is provided from line 58 for converting the LNG into vaporized natural gas. Automatic valves 66 and 68 are provided to control the flow of natural gas through either line 58 or vaporizing loop 62. A microprocessor 70 controls the operation of valves 66 and 68 in response to a signal generated by pressure sensor 72. Pressure sensor 72 generates a signal indicative of the pressure in the vehicle's fueling system, as will hereinafter be described.

Finally, a separate CNG fill line 74 can be provided, if desired, to provide a separate source of compressed natural gas from vaporizing loop 62. It should be noted that the fueling station can operate to fill the vehicle fueling system of FIG. 1 with or without line 74.

The operation of the fueling station will now be described with specific reference to the figures. It should be noted that the vehicle's fueling system can be under a wide variety of conditions when refueling is attempted. For example, the pressure, temperature and amount of LNG in the vehicle's system can be high, low, or at any level in between and in any combination. The filling system of the invention can refuel the vehicle under any of these conditions.

To fill the vehicle fueling system 1, the disconnect coupling 16 is connected to the disconnect coupling 60 of the fueling station. The microprocessor closes valves 66 and 68 to isolate vaporizing loop 62 and activates pump 56. As pump 56 operates, LNG will be forced through line 58 into lines 14, 6, and 8 and into tanks 4 and 6 via spray heads 13 and 15 thereby collapsing the vapor heads in those tanks and lowering the overall pressure and temperature in the system. Because the incoming LNG collapses the vaporheads and lowers the pressure in the system, delivery of LNG to tanks 4 and 6 is possible even where the initial pressure in the vehicle's fueling system is extremely high.

LNG will continue to be delivered to the tanks 4 and 6 until the level of LNG in the tanks rises to the spray heads 13 and 15. When this occurs, pressure sensor 72 will sense the increase in pressure in line 58 and will deliver a signal to microprocessor 70 indicating that tanks 4 and 6 are full. Microprocessor 70, in response to that signal, will open valves 66 and 68 to allow the LNG to enter vaporizing loop 62.

Pump 56 will continue to operate, forcing natural gas through loop 62 and into tanks 4 and 6. As more natural gas vapor is forced into tanks 4 and 6 the natural gas vapor will compress and the pressure in the system will rise. As the pressure increases, some of the LNG originally delivered to tanks 4 and 6 will be forced from these tanks into overflow tank 38.

This process will continue with the natural gas being compressed and the pressure increasing until the pressure in the system reaches a predetermined maximum value. That maximum value is selected to be at or above the pressure required at the use device. Microprocessor 70, which had been monitoring the pressure in the system based on signals from pressure sensor 72 during the entire filling operation, will close valves 66 and 68 and turn off pump 56 when the predetermined maximum pressure is obtained.

Once this pressure is obtained the pressure in each of tanks 2, 4 and 38 will be at equilibrium with each tank containing a portion of the LNG and a compressed natural gas vapor head at the desired pressure. The disconnect couplings 16 and 60 are then disconnected. With this system the vehicle can immediately drive away because the pressure in the fueling system is at the pressure required by the use device. Because the system is at equilibrium, the compressed natural gas vapor head will not collapse as the LNG sloshes in the tanks due to the movement of the vehicle. As a result, the pressure in the system will be maintained at the desired level.

As the use device demands more fuel, the natural gas in tank 38 will be delivered to the use device and tank 38 will be resupplied from tanks 4 and 6. The natural gas can be supplied as LNG through lines 22, 24 and 40 or as natural gas vapor through lines 28, 30 and 44. The natural gas will be supplied as a vapor when the pressure in the system or in any one of the tanks rises above the predetermined value set at regulators 32, 34 or 46. Because it is impossible to eliminate heat transfer to the LNG, the pressure in the system will tend to increase, especially if there is no demand for LNG by the use device. The regulators allow the gas vapor to be delivered to the use device thereby maintaining an upper limit on the pressure in the system.

While the invention has been described in some detail with respect to the figures, it will be appreciated that numerous changes can be made in the details and construction of the system without departing from the spirit and scope of the invention.

What is claimed is:

1. A fueling station for delivering liquid natural gas and high pressure natural gas vapor to a vehicle, comprising:

a) means for storing a quantity of liquid natural gas at low pressure;

b) first means for delivering natural gas from the means for storing to the vehicle;

c) second means for converting the liquid natural gas into natural gas vapor before it is delivered to the vehicle;

d) means for sensing the pressure in the means for delivery, said sensed pressure corresponding to the pressure in the vehicle, and for generating a first signal when the sensed pressure reaches a first predetermined value and a second signal when the sensed pressure reaches a second predetermined value; and e) control means for receiving both said first and second signals and for delivering liquid natural gas until said first signal is received and delivering natural gas vapor until said second signal is received.

2. The fueling station according to claim 1, wherein said second means includes a means for vaporizing the liquid natural gas.

3. The fueling station according to claim 1, wherein the control means includes a valve means for allowing or preventing natural gas to flow to the second means and a microprocessor for controlling the valve means in response to said signals.

* * * * *